United States Patent [19]

Schwartz et al.

[11] Patent Number: 4,686,058

[45] Date of Patent: Aug. 11, 1987

[54] THICKENED-WATER BASED HYDRAULIC FLUIDS

[75] Inventors: Ellen S. Schwartz, Warren; Pauls Davis, Gibraltar, both of Mich.; Jerrold F. Maxwell, Matteson, Ill.

[73] Assignee: BASF Corporation, Wyandotte, Mich.

[21] Appl. No.: 524,245

[22] Filed: Aug. 18, 1983

Related U.S. Application Data

[62] Division of Ser. No. 253,716, Apr. 13, 1981, abandoned.

[51] Int. Cl.[4] ..... C10M 173/00

[52] U.S. Cl. ..... 252/75; 252/73; 252/76; 252/77; 252/78.1; 252/79

[58] Field of Search ..... 252/73, 76, 77, 78.1, 252/79, 75

[56] References Cited

U.S. PATENT DOCUMENTS

| | | | |
|---|---|---|---|
| 4,138,346 | 2/1979 | Nassry et al. | 252/75 |
| 4,151,099 | 4/1979 | Nassry et al. | 252/76 |
| 4,257,902 | 3/1981 | Singer | 252/75 |
| 4,354,956 | 10/1982 | Camp | 252/73 |
| 4,390,440 | 6/1983 | Schwartz et al. | 252/76 |

*Primary Examiner*—Robert A. Wax

*Attorney, Agent, or Firm*—Joseph D. Michaels; David L. Hedden

[57] ABSTRACT

This invention relates to thickened high-viscosity water based hydraulic fluids. Such fluids are prepared by blending water, organic thickener and conventional hydraulic fluid additives. Organic thickeners tend to lose their thickening effect with time, and particularly when subjected to oxidizing agents, heat, prolonged use in a pump, etc. In accordance with the instant invention, preservation of the thickener, particularly with respect to viscosity loss, is achieved by blending with the final fluid a fluid concentrate, or the thickener itself, a compound selected from the group consisting of ethylene glycol, propylene glycol, propylene glycol polymers and copolymers containing at least 50 percent by weight of oxypropylene groups, a dimercaptothiadiazole, neodecanoic acid, a hindered phenol antioxidant and mixtures thereof.

10 Claims, No Drawings

THICKENED-WATER BASED HYDRAULIC FLUIDS

This is a division of application Ser. No. 253,716, filed Apr. 13, 1981, now abandoned.

BACKGROUND OF THE INVENTION

1. Field of the Invention

This invention relates to viscosity stabilization in water-based hydraulic fluids thickened with water-soluble polymers.

2. Prior Art

In the technology of hydraulic power transmission, mechanical power is imparted to a fluid called "a hydraulic fluid" in the form of pressure by means of a hydraulic pump. Power is utilized where desired by tapping a source of said hydraulic fluid thus transforming the power as pressure back to mechanical motion by a mechanism called a hydraulic motor. The hydraulic fluid is utilized as a pressure and volume transmitting medium. Any non-compressible fluid can perform this function. Water is the oldest fluid used for this purpose and is still sometimes used alone for this purpose. In the prior art, there has been a heavy emphasis on the development of petroleum oils for use as hydraulic fluids and, consequently, much of the equipment utilized with hydraulic fluids has been designed and manufactured specifically for use with petroleum oils. A petroleum oil in comparison with water as a hydraulic fluid possesses the advantage of inhibiting the development of rust of the ferrous components of the mechanical equipment utilized in conjunction with hydraulic fluids, (i.e., hydraulic pumps, motors, etc.) and in preventing wear of the machinery since the hydraulic fluid must lubricate the equipment. Petroleum oils have a second advantage over the use of water as a hydraulic fluid in that the petroleum oils normally exhibit a substantially higher viscosity than water and thus contribute to reduction of the leakage of the fluid in the mechanical equipment utilized. In addition, the technology relating to additives for petroleum oils has developed to such an extent that the viscosity, foam stability, wear prevention and corrosion prevention properties of such petroleum oil-based hydraulic fluids can be further enhanced by the use of said additives.

Over the past 25 years, various substitutes for petroleum oil-based hydraulic fluids have been developed in order to overcome one of the major deficiencies of petroleum oils, namely, flammability. Recent interest in the use of hydraulic fluids having up to 99 percent or more of water has resulted from the higher cost of petroleum oils and recent emphasis on problems of ecologically suitable disposal of contaminated or spent petroleum oil-based hydraulic fluids.

Metalworking fluids of the so-called "soluble oil" type have been considered for use as hydraulic fluids. Such fluids contain mineral oil and emulsifiers as well as various additives to increase corrosion resistance and improve antiwear and defoaming properties. Such fluids, when used as hydraulic fluids, are not generally suitable for use in ordinary industrial equipment designed specifically for use with the petroleum oil-based hydraulic fluids since such fluids do not adequately prevent wear damage in some types of pumps and valves of such equipment. However, such fluids have found application in specially designed, high cost, large size equipment which, because of said large size and thus inflexibility, is not suitable for use in most industrial plants. The soluble oil hydraulic fluid usage has thus been quite limited; usage has been largely confined to large installations where flexibility and size are not critical, such as in steel mills.

It is also known to use, in equipment designed for use in mineral oil-based hydraulic fluids, flame-resistant glycol-water based hydraulic fluids such as are disclosed in U.S. Pat. No. 2,947,699. Up until recently, water-based hydraulic fluids containing about 70 to 99+percent water, have had very poor lubricating characteristics. While hydraulic fluids are used primarily to transmit forces, it is necessary that they provide lubrication for the impeller, rings, vanes, gears, pistons and cylinders and other mechanical parts of hydraulic pumps in such systems in order to prevent excessive wear on such parts.

Many prior art fluids, such as the petroleum oil type, are highly flammable and unsuitable for certain uses where such fluids have frequently been the source of fire. Where these fluids are used to control such industrial operations as heavy casting machines, which are operated largely by hydraulic means, danger of fire exists. Therefore, there is a growing demand for hydraulic fluids characterized by reduced flammability.

Hydraulic fluid compositions having water as a base are disclosed in U.S. Pat. Nos. 4,151,099 and 4,138,346. These patents disclose fluids comprising 1) a sulfur containing compound and 2) a phosphate ester salt. The U.S. 4,151,099 patent also includes a water-soluble polyoxyethylated ester of an aliphatic acid and a monohydric or polyhydric aliphatic alcohol, either one or both said acid and said alcohol being polyoxyethylated. These hydraulic fluids are optionally thickened with a polyglycol thickener.

In U.S. Pat. No. 2,558,030 a hydraulic fluid is disclosed having an organic polymeric thickener such as copolymers of ethylene oxide and propylene oxide having high molecular weight which includes ethylene glycol as well as sodium mercaptobenzothiazole. However, there is no disclosure of dimercaptothiadiazole.

U.S. Pat. Nos. 3,909,448 and 2,803,140 disclose 2,5-dimercaptothiadiazole as an antioxidant for organic materials. However, they do not relate to hydraulic fluids.

U.S. Pat. No. 2,602,780 discloses hydraulic fluids with soluble polymeric thickeners such as copolymers of ethylene oxide and propylene oxide having molecular weights of 15,000 to 20,000. In combination therewith it discloses the use of ethylene glycol and propylene glycol. However, the ethylene glycol and propylene glycol are employed as freezing point depressants and are included in a list of many freezing point depressants. The patent also discloses the inclusion of thiazoles and substituted thiazole salts such as alkali metal mercatobenzothiazoles.

U.S. Pat. No. 2,751,356 discloses a hydraulic pressure transmitting fluid comprising polymerized lower alkylene glycols containing as additives ethylene glycol and propylene glycol and also the sodium salt of mercaptobenzothiazole. These latter products are provided in a list of diluents or solvents.

From the above it can be seen that it is well known in the art to employ organic polymeric thickeners such as copolymers of ethylene oxide and propylene oxide having high molecular weight. However, such thickening agents, particularly when heated, are subjected to oxidizing conditions which result in the loss of the thickening effect, i.e. a loss of viscosity in the hydraulic fluid.

SUMMARY OF THE INVENTION

This invention relates to thickened high-viscosity water based hydraulic fluids. Such fluids are prepared by blending water, organic thickener and conventional hydraulic fluid additives. As previously stated, organic thickeners tend to lose their thickening effect with time, and particularly when subjected to oxidizing agents, heat, prolonged use in a pump, etc. In accordance with the instant invention, preservation of the thickener, particularly with respect to viscosity loss, is achieved by blending with the fluid a compound selected from the group consisting of ethylene glycol, propylene glycol, propylene glycol polymers and copolymers containing at least 50 percent by weight of oxypropylene groups, a dimercaptothiadiazole, neodecanoic acid, a hindered phenol antioxidant and mixtures thereof. The hydraulic fluid may be prepared by first preparing a concentrate containing from about 0 to 85 percent by weight of water which is a most convenient form for shipping and which after shipping is then further diluted with about 60 to 99 percent by weight water. The above compounds which are added to preserve the thickener and particularly to reduce viscosity loss may be added to the thickener, the concentrate or to a finally prepared hydraulic fluid. When added to the thickener itself, it helps preserve the thickener giving improved shelf life for the thickener itself prior to any blending of the thickener with the other hydraulic fluid components.

In a preferrred embodiment a compound selected from the group consisting of ethylene glycol, propylene glycol, propylene glycol polymers and copolymers containing at least 50 percent by weight oxypropylene groups, a dimercaptothiadiazole, neodecanoic acid, and mixtures thereof is blended with the final hydraulic fluid or the concentrate. In another preferred embodiment of the invention, a compound selected from the group consisting of ethylene glycol, propylene glycol, propylene glycol polymers and copolymers containing 50 percent by weight oxypropylene groups, dimercaptothiadiazole, neodecanoic acid, a hindered phenol antioxidant and mixtures thereof are blended first with the thickener prior to blending the thickener with either the concentrate or the final fluid.

DESCRIPTION OF THE PREFERRED EMBODIMENTS

In accordance with the instant invention the thickener may be of the polyglycol type. Such thickeners are well known in the art and are polyoxyalkylene polyols, having a molecular weight of about 2,000 to 40,000, prepared by reacting an alkylene oxide with a linear or branched chain polyhydric alcohol.

Preferred polyether polyol thickeners utilized to thicken the hydraulic fluids of the invention can be obtained by modifying a conventional polyether polyol thickening agent such as described above with an alpha-olefin epoxide or glycidyl ether having about 10 to 22 carbon atoms or mixtures thereof. Small amounts of higher molecular weight glycols may be incorporated into the chain. The conventional polyether polyol thickening agent can be an ethylene oxide homopolymer or a heteric or block copolymer of ethylene oxide and at least one lower alkylene oxide having 3 to 4 carbon atoms. Said ethylene oxide is used in the proportion of at least about 60 percent by weight based upon the total weight of the polyether polyol. Generally, about 70 to 100 percent by weight ethylene oxide is utilized with about 30 to 0 percent by weight of lower alkylene oxide having 3 to 4 carbon atoms.

Polyether polyols are generally prepared utilizing an active hydrogen-containing compound having 1,2,3 or more active hydrogens in the presence of an acid or basic oxyalkylation catalyst and an inert organic solvent at elevated temperatures in the range of about 50° C. to 150° C. under an inert gas pressure generally from about 20 to about 100 pounds per square inch gauge. Polyether polyols suitable as thickeners can be prepared by further reacting a polyether polyol as described above having a molecular weight of about 1000 to about 40,000, preferably 2000 to about 30,000 with said alpha-olefin epoxide so as to provide an alpha-olefin epoxide cap on the polyether polyol. The amount of alpha-olefin epoxide required to obtain the modified polyether polyol thickening agents of the invention is about 1 to about 20 percent by weight based upon the total weight of the modified polyether polyol thickeners. Alternatively, the modified polyether polyol thickening agents can be obtained by the copolymerization of a mixture of ethylene oxide and at least one other lower alkylene oxide having 3 to 4 carbon atoms with an alpha-olefin epoxide having about 12 to 18 carbon atoms or mixtures thereof. Further details of the preparation of the alpha-olefin epoxide modified polyether polyol thickening agents useful in the preparation of the hydraulic fluids of the invention can be obtained from co-pending applications Ser. No. 86,837 filed on Oct. 22, 1979 and Ser. No. 86,840 filed Oct. 22, 1979, both incorporated herein by reference.

Generally, about 10 to 60 percent of such thickeners based on the weight of the concentrate, or 1 to 10 percent based on the weight of the final hydraulic fluid will provide the desired viscosity.

In order to eliminate or substantially reduce viscosity loss in a thickened hydraulic fluid, the compounds selected from the group consisting of ethylene glycol, propylene glycol, propylene glycol polymers and copolymers containing at least 50 percent by weight oxypropylene groups, a dimercaptothiadiazole, neodecanoic acid, hindered phenol antioxidant, and mixtures thereof are blended with said fluid.

Preferred hindered phenol antioxidants for protecting the pure thickener are: 4,4'-(1-methylethylidene)bisphenol better known as Bisphenol A, 3,5-bis(1,1-dimethylethyl)-4-hydroxybenzene propanoic acid, octadecylester sold under the trademark IRGANOX 1076, bis-2,6-ditert-butylphenol derivative with a molecular weight of 640 sold under the trademark IRGANOX L109, thiodiethylene bis-(3,5-di-tert-butyl-4-hydroxy)-hydrocinnamate sold under the trademark IRGANOX 1035, and 2,6-bis(1,1-dimethylethyl)-4-methylphenol butylated hydroxyanisole sold under the trademark IONOL.

While decanoic, also known as capric, acid has been well known in the art for years, the neoacids, which are synthetic highly-branched organic acids, are relatively new. The "neo" structure is generally considered to be as follows:

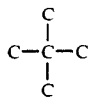

Commercially produced neodecanoic acid is composed of a number of $C_{10}$ isomers characterized by the presence of the above structure but in varying locations along the chain. It is generally a liquid with a low freezing point, i.e., less than −40° C., whereas decanoic (capric) acid is a solid melting at 31.4° C. Neodecanoic acid is synthesized starting with an olefin of mixed nonenes (at equilibrium) yielding a $C_{10}$ neoacid containing many isomers. This very highly branched and multi-isomer acid combination yields a liquid C10 neoacid with a typical hydrocarbon-type odor. A typical structure and isomer distribution for neodecanoic acid is set forth below.

Typical Isomer Distribution for Neodecanoic Acid

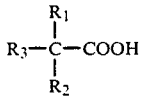

| Alkyl Group | % |
|---|---|
| $R_1$ and $R_2$ = methyl | 31 |
| $R_1$ = methyl; $R_2$ > methyl | 67 |
| $R_1$ and $R_2$ > methyl | 2 |
| $R_3$ always > methyl | |

This product is described in the article entitled "Neoacids: Synthetic Highly Branched Organic Acids", *Journal of American Oil Chemists Society,* Vol. 55, No. 4, pp. 342A to 345A (1978).

The molecular weight of the propylene glycol polymers or copolymers is about 75 to 5000.

The preferred propylene glycol copolymers may be heteric or block copolymers which are the reaction product of a linear or branched active hydrogen containing compound having from 1 to 6 carbon atoms with alkylene oxides having from 3 to 6 carbon atoms and an oxygen/carbon atom ratio of less than 0.4 and with alkylene oxides having an oxygen/carbon atom ratio of greater than 0.4. Suitable active hydrogen containing compounds include propylene glycol, ethylene glycol, diethylene glycol, glycerine, pentaerythritol, trimethylol propane, ethylene diamine and the like. Suitable alkylene oxides having an oxygen/carbon ratio of less than 0.4 are propylene oxide, butylene oxide and amylene oxide. Suitable alkylene oxides having an oxygen/carbon atom ratio greater than 0.4 are ethylene oxide, butadiene dioxide and glycidol. The preferred block copolymers are co-generic mixtures of conjugated polyoxyalkylene compounds containing in their structure the residue of an active hydrogen containing compound having from 1 to 6 carbon atoms; at least one hydrophobic oxyalkylene chain in which the oxygen/carbon atom ratio does not exceed 0.4 and at least one hydrophilic oxyalkylene chain in which the oxygen/carbon atom ratio is greater than 0.4. Polymers of oxyalkylene groups obtained from propylene oxide, butylene oxide, amylene oxide, mixtures of such oxyalkylene groups with each other and with minor amounts of oxyalkylene groups obtained from ethylene oxide, butadiene dioxide and glycidol are illustrative of hydrophobic oxyalkylene chains having an oxygen/carbon atom ratio not exceeding 0.4. Polymers of oxyalkylene groups obtained from ethylene oxide, butadiene dioxide, glycidol, mixtures of such oxyalkylene groups with each other and with minor amounts of oxyalkylene groups obtained from propylene oxide, butylene oxide, amylene oxide and styrene oxide are illustrative of hydrophilic oxyalkylene chains having an oxygen/carbon atom ratio greater than 0.4.

The above polyoxyalkylene copolymers have a molecular weight of the 3 to 6 carbon atom oxyalkylene groups from about 950 to 5000 and the molecular weight of the 3 to 6 carbon atom groups is from about 50 to 100 percent of the total molecular weight.

Among the conjugated polyoxyalkylene compounds which can be used in the compositions of the invention are those which correspond to the formula:

$$Y[(C_3H_6O)_n(C_2H_4O)_mH]_x$$

wherein Y is the residue of an organic compound having from about 1 to 6 carbon atoms and containing x reactive hydrogen atoms, in which x has a value of at least one, m has a value such that the oxypropylene content of the molecule is from about 50 to 100 weight percent and the total molecular weight of the polyoxypropylene groups is from about 950 to 5000. Compositions of this type are more particularly described in U.S. Pat. Nos. 2,674,619 and 2,677,700.

Other suitable block copolymers correspond to the formula:

$$Y[(C_2H_4O)_m(C_3H_6O)_nH]_x$$

wherein Y, n, m and x have values as set forth above. Compositions of this type are more particularly described in U.S. Pat. No. 3,036,118. In either of the above formulas, compounds falling within the scope of the definition for Y include, for example, propylene glycol, ethylene glycol, dipropylene glycol, diethylene glycol, glycerine, pentaerathritol, trimethylol propane, ethylene diamine and the like. Also, the oxypropylene chains optionally, but advantageously, contain small amounts of ethylene oxide and the oxyethylene chains also optionally, but advantageously, contain small amounts of propylene oxide.

Preferred compounds of the above type are those wherein Y is the residue of propylene glycol or ethylene glycol and x is 2.

Other suitable copolymers are copolymers of propylene glycol with butylene oxide and glycidyl ethers.

Each of the above viscosity loss reducing compounds may be used singly or in combination with one or more of the other compounds set forth above. Generally the total amount of said compounds would range from about 0.1 to 50 percent by weight in the final hydraulic fluid. Where a concentrate is prepared first, the amount of said compounds would be about 5 to 75 percent based on the weight of the concentrate. In general there is little or no advantage to a final fluid containing more than 10 percent by weight of the viscosity reducing compounds. Since compounds which reduce viscosity loss may be used in combination with each other or singly, the amount of each one in the final hydraulic fluid may range from about 1.0 to 50 percent ethylene glycol, about 0.5 to 50 percent of propylene glycol, about 0.1 to 50 percent propylene glycol polymer or copolymer, about 0.05 to 3 percent dimercaptothiadiazole, about 0.05 to 3 percent neodecanoic acid, and about 0.05 to 3 percent of hindered phenol antioxidant. In any event, the total amount of said viscosity loss reducing compounds in the concentrate would not exceed 50 percent by weight of the final fluid or 75 percent by weight of the concentrate with a minimum of 0.5 percent by weight of the concentrate. The preferred amount of each of said viscosity loss reducing compounds in the concentrate is from about 5 to 75 percent ethylene glycol, 5 to 75 percent propylene glycol, about 1 to 75 percent propylene glycol polymer or copolymer, about 0.5 to 20 percent dimercaptothiadiazole, about 0.5 to 20 percent neodecanoic acid, and about 0.5 to 20 percent hindered phenol antioxidant by weight of the concentrate.

As previously pointed out, all of the viscosity loss reducing compounds set forth above may be added directly to the final fluid or the concentrate. Further, all of the compounds set forth above may be added to the thickener either prior to addition to the concentrate or prior to direct addition to the final fluid.

The viscosity loss reducing compounds described above may be employed with any conventional high-water hydraulic fluid incorporating any or all of the following prior art components. For example, the hydrualic fluid may contain, as disclosed in U.S. Pat. Nos. 4,151,099 and 4,138,346, a phosphate ester, a sulfur compound, a water-soluble polyoxyethylated aliphatic ester or ether and an alkyldialkanolamide. Optionally, the fluids of the invention can include an additional corrosion inhibitor, a defoamer and a metal deactivator (chelating agent) as well as other conventional additives, such as dyes in normal amounts.

The phosphate ester may be selected from the group consisting of

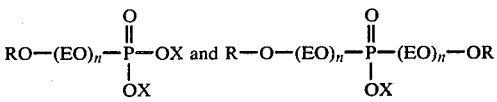

and mixtures thereof wherein ethylene oxide groups are represented by EO; R is selected from the group consisting of linear or branched chain alkyl groups wherein said alkyl groups have about 6 to 30 carbon atoms, preferably about 8 to 20 carbon atoms, or alkylaryl groups wherein the alkyl groups have about 6 to 30 carbon atoms, preferably about 8 to 18 carbon atoms, and X preferably is selected from the group consisting of hydrogen, alkali or alkaline earth metal, the residue of ammonia or an amine and mixtures thereof, and n is a number from 1 to 50. Metals such as lithium, sodium, potassium, rubidium, cesium, calcium, strontium, and barium are examples of the alkali or alkaline earth metal.

The free acid form of the phosphate ester is preferably utilized in preparing hydraulic fluids in accordance with compositions of the invention. These are more fully disclosed in U.S. Pat. 3,004,056 and 3,004,057, incorporated herein by reference. The free acid form may be converted to the salt form in situ in the preparation of the hydraulic fluids of the invention. Alternatively, the phosphate ester salts can be used directly.

Water-soluble esters of ethoxylated aliphatic acids and/or water soluble ethers of ethoxylated alcohols may be incorporated in the hydraulic fluid as an anti-wear lubricant component. Preferred water-soluble esters or ethers are those of the ethoxylated $C_8$–$C_{36}$ aliphatic monohydric or polyhydric alcohols or aliphatic acids, and aliphatic dimer acids. The most desirable adducts are in the range of 13 to 18 carbons. Suitable esters of ethoxylated aliphatic acids or alcohols are disclosed in U.S. Pat. No. 4,151,099 particularly beginning in column 3 thereof which is hereby incorporated by reference.

Representative water-soluble polyoxyethylated esters having about 5 to about 20 moles of oxide per mole are the polyoxyethylene derivatives of the following esters; sorbitan monooleate, sorbitan trioleate, sorbitan monostearate, sorbitan tristearate, sorbitan monopalmitate, sorbitan monoisostearate, and sorbitan monolaurate.

Conventional sulfur compound additives may also be incorporated in the hydraulic fluid such as the ammonia, amine or metal salts of 2-mercaptobenzothiazole or 5-, 6- and 7-substituted 2-mercaptobenzothiazole, said salts being formed on neutralization of the free acid form of 2-mercaptobenzothiazole with a base. Such sulfur compounds are disclosed particularly beginning in column 5 of U.S. Pat. No. 4,138,346 which is hereby incorporated by reference.

The sulfur-containing compound may also be sulfurized oxymolybdenum and oxyantimony compounds represented by:

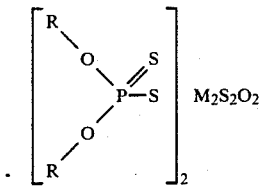

wherein M is molybdenum or antimony and R is organic and is selected from the group consisting of $C_3$–$C_{20}$ alkyl, aryl, alkylaryl radicals and mixtures thereof.

Representative useful molybdenum and antimony compounds are sulfurized oxymolybdenum or oxyantimony organo-phosphorodithioate where the organic portion is alkyl, aryl or alkylaryl and wherein said alkyl has a chain length of 3 to 20 carbon atoms.

The preferred alkyldialkanolamide has the formula

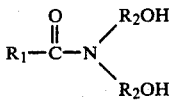

wherein $R_1$ is alkyl of about 4 to about 54, preferably about 4 to about 30, carbon atoms and $R_2$ is alkyl of about 2 to about 6 carbon atoms.

The alkyldialkanolamides are known compositions in the prior art. In general, these compositions are prepared by esterifying a dialkanolamine with an alkyl dicarboxylic acid and removing water of esterification. Useful alkyl dicarboxylic acids include branched or straight chain saturated or unsaturated aliphatic monocarboxylic or dicarboxylic acids as described below. Preferably, the saturated straight chain acids are used and the preferred amides are diethanolamides. Examples of useful alkyldialkanolamides are the alkyl diethanolamides and alkyl dipropanol amides where the alkyl group is derived from a $C_8$–$C_{54}$ dicarboxylic acid.

The advantageous properties contributed to the hydraulic fluid by the alkyldialkanolamide component of the hydraulic fluid of the invention are resistance to precipitation in the presence of hard water, that is, in the presence of large amounts of calcium and magnesium ions in the water utilized to prepare the hydraulic fluid of the invention. In addition, the alkyldialkanolamides contribute to the antiwear and extreme pressure performance of the composition as well as to the metal corrosion resistance which is desirable in such fluids. The alkyldialkanolamides in aqueous solution are completely stable under neutral and alkaline conditions and show little tendency to hydrolyze or decompose on storage.

The hydraulic fluids of the invention generally consist of about 60 percent to about 99 percent water and about 40 percent to about 1 percent concentrate. These concentrates may comprise the viscosity loss reducing compound and thickener possibly in combination with the water-soluble esters of ethoxylated aliphatic acid and/or ethoxylated alcohol ethers and/or sulfur containing compound; and/or phosphate ester, and/or alkyldialkanolamide and, in addition, can contain defoamers, corrosion inhibitors and metal deactivators or chelating agents. Preferably, said fluids consist of about 75 percent to 99 percent water and about 25 percent to about 1 percent concentrate. The fluids are easily formulated at room temperature using tap water although distilled or deionized water can also be used.

The amount of sulfur-containing compound in the hydraulic fluid concentrate of the invention is generally about 0 to 10 percent by weight and when employed is at a minimum of 1.0 percent. The concentration of the phosphate ester in the hydraulic fluid concentrate of the invention is generally about 1.0 to 7.0 percent by weight of the concentrate. The concentration of the water-soluble ester of the ethoxylated alipahtic acid and/or ethoxylated alcohol ether in the hydraulic fluid concentrate of the invention is generally about 1.0 percent to about 7.0 percent by weight. Preferably, the proportion by weight of each of these three components is 1.0 to 5.0 percent.

The percent by weight alkyldialkanolamide in the concentrate is about 1 to 7, preferably about 1 to 5 based upon the total weight of the concentrate. Most preferably, equal amounts of the ester of an ethoxylated aliphatic alcohol and the alkyldialkanolamide are used.

The metal deactivators and corrosion inhibitors which can be added either to the concentrate or to the hydraulic fluid or metalworking compositions of the invention are as follows:

Liquid-vapor corrosion inhibitors may be employed and can be any of the alkali metal nitrites, nitrates and benzoates. Certain amines are also useful. The inhibitors can be used individually or in combinations. Representative examples of the preferred alkali metal nitrates and benzoates which are useful are as follows: sodium nitrate, potassium nitrate, calcium nitrate, barium nitrate, lithium nitrate, strontium nitrate, sodium benzoate, potassium benzoate, calcium benzoate, barium benzoate, lithium benzoate and strontium benzoate.

Representative amine-type corrosion inhibitors are as follows: butylamine, propylamine, n-octylamine, hexylamine, morpholine, N-ethyl morpholine, N-methyl morpholine, aniline, triphenylamine, aminotoluene, ethylene diamine, dimethylaminopropylamine, N,N-dimethyl ethanolamine, triethanolamine, diethanolamine, monoethanolamine, 2-methyl pyridine, 4-methyl pyridine, piperazine, dimethyl morpholine, $\alpha$- and $\gamma$-picoline, isopropylaminoethanol and 2-amino-2-methylpropanol. These amines also function to neutralize the free acid form of the phosphate ester converting it to the salt form.

Imidazolines can be used for their known corrosion inhibiting properties with respect to cast iron and steel. Useful imidazolines are heterocyclic nitrogen compounds having the formula:

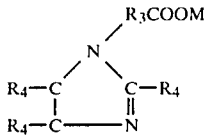

wherein $R_4$ is hydrogen or a monovalent radical selected from the group consisting of alkyl of 1 to 18 carbon atoms, alkylene of 1 to 18 carbon atoms, aryl, and alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal.

It is also contemplated to add other known corrosion inhibitors. Besides the amines, alkali metal nitrates, benzoates and nitrites listed above, the alkoxylated fatty acids are useful as corrosion inhibitors.

The above corrosion inhibitors are employed in the hydraulic fluid concentrates in total amount of about 2 to 25 percent by weight, preferably about 5 to 15 percent by weight. More specifically, it is preferred to employ benzoates or benzoic acid in amount of about 1 to 5 percent, amines in amount of about 2 to 10 percent, and imidazolines in amount of about 2 to 10 percent all by weight of the total amount of concentrate.

Metal deactivators may be used primarily to chelate copper and copper alloys. Such materials are well known in the art and individual compounds can be selected from the broad classes of materials useful for this purpose such as the various triazoles and thiazoles as well as the amine derivatives of salicylidenes. Representative specific examples of these metal deactivators are as follows: benzotriazole, tolyltriazole, 2-mercaptobenzothiazole, sodium 2-mercaptobenzothiazole, and N,N'-disalicylidene-1,2-propanediamine. The concentration of metal deactivator to water in the hydraulic fluid concentrates of the invention is generally about 2 to 10 percent by weight and preferably about 3 to 5 percent by weight.

Conventional defoamers such as the well known organic surfactant defoamers, for example nonionic defoamers such as the polyoxyalkylene type nonionic surfactants, may also be employed in normal amounts. Preferred amounts are about 0.5 to 5.0 percent by weight of the total amount of concentrate. The concentrate may contain other conventional hydraulic fluid additives and possibly some impurities in normal minimal amounts.

The phosphate esters and esters of ethoxylated alipahtic acids and alcohols are water-soluble in the sense that no special method is required to disperse these materials in water and keep them in suspension over long periods of time. As a means of reducing corrosion, the pH of the water in the fluids of the invention is maintained above 7.0, preferably 7.0 to about 11.0, and most preferably 9 to about 10.5. Preferably, pH of the fluid concentrates is adjusted with an alkali metal or alkaline earth metal hydroxide, or carbonate, ammonia or an amine. Where these are employed, benzoic acid may be employed in lieu of alkali metal benzoates. The sulfurized molybdenum or antimony compounds on the other hand are insoluble in water and require emulsification prior to use, for instance, with anionic or nonionic surfactants. Useful representative anionic or nonionic surfactants are: sodium petroleum sulfonate, i.e., sodium dodecylbenzene sulfonate; polyoxyethylated fatty alcohol or fatty acid and polyoxyethylated alkyl phenol.

The concentrates of the hydraulic fluids of this invention can be made up completely free of water or contain any desired amount of water but preferably contain up to 85 percent by weight of water to increase fluidity and provide ease of blending at the point of use. As pointed out above, these concentrates are typically diluted with water in the proportion of 1:99 to 40:60 to make up the final hydraulic fluid.

The preferred final hydraulic fluid of the invention may include by weight one or more of the following conventional additives:

about 0.01 to 3.0 percent water soluble ester of exothylated aliphatic acid and/or ethoxylated alcohol ether, 0.01 to 2.0 percent sulfur-containing compound, about 0.01 to 3.0 percent ethoxylated phosphate ester, or salt thereof, about 0.01 to 3 percent alkyldialkanolamide, about 0.05 to 10 percent additional corrosion inhibitors and most preferably about 0.01 to 2 percent benzoic acid and/or benzoates, about 0.02 to 2 percent amine type corrosion inhibitors and about 0.02 to 2 percent ethoxylated imidazoline, about 0.02 to 5 percent metal deactivators, about 0.02 to 1 percent defoamers plus other conventional additives such as dyes and impurities in normal amounts.

The following examples more fully describe the hydraulic fluids of the invention and show the unexpected results obtained by their use.

In the examples:

The Vane Pump Test procedure used herein employs a Vickers 104C vane pump with a 5 gallon sump. This comprises charging the system with 5 gallons of the test fluid and pumping at a rate of 8 gpm at a temperature of 100° F. at 1000 psi pump discharge pressure. Wear data were obtained by weighing the cam-ring and the vanes of the "pump cartridge" before and after the test.

Thickener #1 is a branched heteric copolymer of ethylene oxide, and 1,2-propylene oxide having a molecular weight of 15,000 using trimethylolpropane as an initiator and containing 85 percent oxyethylene units, and 15 percent oxypropylene units. This basic heteric copolymer is further reacted with a mixture of alpha olefin epoxides having 15 to 18 carbon atoms.

Thickener #2 is a branched heteric copolymer of ethylene oxide and 1,2-propylene oxide using trimethylol propane as an initiator and containing 85 percent oxyethylene units, and 15 percent oxypropylene units. This basic heteric copolymer is further reacted with a mixture of alpha-olefin epoxides having 15 to 18 carbon atoms. The total molecular weight is approximately 11,000.

Thickener #3 is a branched heteric copolymer of ethylene oxide and 1,2-propylene oxide using trimethylol propane as an initiator and containing approximately 80 percent oxyethylene units, and approximately 20 percent oxypropylene units. This basic heteric copolymer is further reacted with a mixture of alpha olefin epoxides having 15 to 18 carbon atoms. The molecular weight is approximately 7000.

Thickener #4 is a branched heteric copolymer of ethylene oxide and 1,2-propylene oxide using trimethylolpropane as an initiator and containing 85 percent oxyethylene units, and 15 percent oxypropylene units. This basic heteric copolymer is further reacted with a mixture of alpha-olefin epoxides having 15 to 18 carbon atoms. The molecular weight is approximately 17,000.

The propylene oxide polymer is polyoxypropylene glycol having a molecular weight of approximately 410.

Polyoxyalkylene copolymer No. 1—defines the polyoxyethylene adduct of a polyoxypropylene hydrophobic base, said hydrophobic base having a molecular weight of about 1750 wherein the oxypropylene content is about 90 weight percent of the molecule. This product is readily available on the market under the trademark PLURONIC L61.

Polyoxyalkylene copolymer No. 2 defines the polyoxyethylene adduct of a polyoxypropylene hydrophobic base, said base having a molecular weight about 1750 wherein the oxypropylene content is about 60 percent by weight of the molecule. This product is readily available on the market under the trademark PLURONIC L64.

The pentaerythritol propylene oxide polymer has a molecular weight of approximately 450.

Antioxidant #1 is a hindered phenol antioxidant and may be described as 3,5-bis(1,1-dimethylethyl)-4-hydroxybenzene propanoic acid, octadecyl ester. This product is readily available on the market under the trademark IRGANOX 1076.

Antioxidant #2 is a butylated reaction product of p-cresol and dicyclopentadiene and is available on the market under the trademark WINGSTAY L.

THIOKOL is a polysulfide rubber.

In the examples the phosphate ester utilized is reputed to be the reaction product of one mole of phosphorus pentoxide with a condensation product of one mole of nonylphenol and approximately four moles of ethylene oxide in accordance with the methods disclosed in U.S. Pat. Nos. 3,004,056 and 3,004,057.

The examples are intended for the purpose of illustration. Throughout the application, all parts, proportions, and percentages are by weight and all temperatures are in degrees centigrade unless otherwise noted.

EXAMPLE 1

A hydraulic fluid concentrate, indicated herein as Concentrate A, was prepared by blending 76.45 parts by weight of water, 3 parts by weight of ethoxylated phosphate ester, 3 parts by weight of a $C_{21}$ diethoxylated diacid mixed with a $C_{21}$ diethanol diamide. 5 parts by weight of 2-amino-2-methyl-1-propanol (95 percent aqueous solution), 4.5 parts by weight of a 50 percent by weight aqueous solution of tolyltriazole, 4 parts by weight of a 95 percent 2-heptyl-1-(ethoxypropionic acid) imidazoline, sodium salt in 5 percent of ethanol, 2 parts by weight of benzoic acid, 2 parts by weight polyoxyalkylene copolymer #1 and 0.05 percent by weight dye.

From Concentrate A a stock solution of the following composition was prepared:

| | Weight % |
|---|---|
| Concentrate A | 5.0 |
| Neodecanoic Acid | 0.5 |

-continued

| | Weight % |
|---|---|
| Thickener #1 | 4.0 |
| Water | 90.5 |

Pairs of duplicate samples of the above stock solution were prepared containing each of the additives of Table I below. One milliliter of peroxide solution was added to one sample of each pair and one milliliter of water was added to the other. The percent viscosity loss (S.U.S.) for each pair of samples as a result of the peroxide addition is shown in Table I below:

TABLE I

| Stock solution | 98 | 98 | 97 | 97 | 94 | 94 | 89 | 89 | 98 | 98 | 98 | 98 | 97 | 97 | 98 | 98 | 97 | 97 | 98 | 98 |
|---|---|---|---|---|---|---|---|---|---|---|---|---|---|---|---|---|---|---|---|---|
| Propylene glycol | 1 | 1 | 2 | 2 | 5 | 5 | 10 | 10 | | | | | 1 | 1 | | | | | | |
| Tolyltriazole (50%) | | | | | | | | | | | | | 1 | 1 | | | | | 0.5 | 0.5 |
| Na Mercaptobenzothiazole (50%) | | | | | | | | | | | 1 | 1 | | | | | | | | |
| Antioxidant #1 | | | | | | | | | | | | | | | 1 | 1 | | | | |
| Propylene oxide polymer | | | | | | | | | | | | | | | | | 2 | 2 | 0.5 | 0.5 |
| Hydrogen peroxide | | 1 | | 1 | | 1 | | 1 | | 1 | | 1 | | 1 | | 1 | | 1 | | 1 |
| Water | 1 | | 1 | | 1 | | 1 | | 1 | | 1 | | 1 | | 1 | | 1 | | 1 | |
| % Viscosity loss in peroxide | | 5.45 | | 7.1 | | 6.0 | | None | | 36.8 | | 29.2 | | 9.4 | | 52.1 | | 2.7 | | 3.7 |

EXAMPLE 2

From Concentrate A a stock solution of the following composition was prepared:

| | Weight % |
|---|---|
| Concentrate A | 5.0 |
| Neodecanoic Acid | 0.5 |
| Thickener #2 | 3.0 |
| Water | 91.5 |

In making the test of Example 1 it was noted that the greater the viscosity loss, the greater the amount of dye decolorization in the test solution. Since observation of dye decolorization is quicker to determine than viscosity loss, dye decolorization was then used as a measure of oxidative attack on the fluid system.

Pairs of duplicate samples of the above stock solution were prepared containing each of the additives of Table II below. One milliliter of peroxide solution was added to one sample of each pair and one milliliter of water was added to the other. The degree of dye decolorization for each pair of samples as a result of the peroxide addition is shown in Table II below.

EXAMPLE 3

Accelerated pump tests were run on the composition of Table III below with results as shown therein.

TABLE III

| | | |
|---|---|---|
| Concentrate A | 5 | 5 |
| Thickener #3 | 8 | 8 |
| Propylene Glycol | 10 | 0 |
| Tolyltriazole (50%) | 1 | 0 |
| Water | 76 | 87 |
| Duration of pump test, hours | 135.7 | 145.7 |
| Percent Viscosity Loss | 9 | 27 |

EXAMPLE 4

A hydraulic fluid concentrate, indicated herein as Concentrate B, was prepared by blending 44.45 parts by weight of water, 3 parts by weight of ethoxylated phosphate ester, 5 parts by weight of 2-amino-2-methyl-1-propanol (95 percent aqueous solution), 4.5 parts by weight of a 50 percent by weight aqueous solution of tolyltriazole, 4 parts by weight of a 95 percent 2-heptyl-1-(ethoxypropionic acid) imidazoline, sodium salt in 5 percent of ethanol, 2 parts by weight of benzoic acid, 4 parts by weight 2-ethylhexanol, 6 parts by weight neodecanoic acid, 20 parts by weight pentaerythritol propylene oxide polymer and sodium hydroxide in amount sufficient to adjust the pH to approximately 10.4.

From concentrate B, the following fluids were prepared:

| | Weight % | |
|---|---|---|
| Fluid | 1 | 2 |
| Concentrate B | 5.0 | 5.0 |
| Thickener #4 | 2.5 | 2.5 |
| Polyoxyalkylene Copolymer #1 | — | 0.10 |
| Water | 92.50 | 92.4 |

TABLE II

| Stock solution | 98 | 98 | 98 | 98 | 98 | 98 | 98 | 98 | 97 | 97 | 97 | 97 | 97 | 97 | 98 | 98 | 98 | 98 | 99 | 99 |
|---|---|---|---|---|---|---|---|---|---|---|---|---|---|---|---|---|---|---|---|---|
| Pentaerythritol-propylene oxide polymer | 1 | 1 | | | | | | | | | | | | | | | | | | |
| Sodium dibutyl dithiocarbamate | | | 1 | 1 | | | | | | | | | | | | | | | | |
| Sodium phosphite (antioxidant) | | | | | 1 | 1 | | | | | | | | | | | | | | |
| Polyoxyalkylene copolymer #2 | | | | | | | 1 | 1 | 1 | 1 | 1 | 1 | 1 | 1 | | | | | | |
| Dibutyl phosphite (antioxidant) | | | | | | | | | 1 | 1 | | | | | | | | | | |
| Antioxidant #2 | | | | | | | | | | | 1 | 1 | | | | | | | | |
| THIOKOL | | | | | | | | | | | | | 1 | 1 | | | | | | |
| Propylene oxide polymer | | | | | | | | | | | | | | | 1 | 1 | | | | |
| Di(triethanol ammonium) dimercaptothiadiazole | | | | | | | | | | | | | | | | | 1 | 1 | | |
| Hydrogen peroxide | | 1 | | 1 | | 1 | | 1 | | 1 | | 1 | | 1 | | 1 | | 1 | | 1 |
| Water | 1 | | 1 | | 1 | | 1 | | 1 | | 1 | | 1 | | 1 | | 1 | | 1 | |
| Decolorization rating | 1 | 5 | 3 | 8 | 2 | 8 | 1 | 5 | 5 | 9 | 2 | 10 | 2 | 10 | 1 | 7 | 1 | 3 | 1 | 7–10 |

(1) = no decolorization; (10) = severe decolorization

Accelerated pump tests were run on the above compositions for 17 to 20 hours with the following results:

| Fluid | 1 | 2 |
|---|---|---|
| Viscosity Loss in Pump Test, S.U.S. | 112 | 52.4 |

The example demonstrates that polyoxyalkylene copolymer #1 in very small amount substantially reduces viscosity loss in the pump test.

EXAMPLE 5

A hydraulic fluid concentrate, indicated herein as Concentrate C, was prepared by blending 62.45 parts by weight of water, 3 parts by weight of ethoxylated phosphate ester, 3 parts by weight of a $C_{21}$ diethoxylated diacid mixed with a $C_{21}$ diethanol diamide. 9 parts by weight of 2-amino-2-methyl-1-propanol (95 percent aqueous solution), 4.5 parts by weight of a 50 percent by weight aqueous solution of tolyltriazole, 4 parts by weight of a 95 percent solution of 2-heptyl-1-(ethoxy-propionic acid) imidazoline, sodium salt in 5 percent ethanol, 2 parts by weight of benzoic acid, 0.05 parts by weight dye, 6 parts by weight neodecanoic acid, 4 parts by weight 2-ethylhexanol, 2 parts by weight polyoxyalkylene copolymer #1 and sodium hydroxide in amount sufficient to adjust the pH to approximately 10.4.

From Concentrate C, the following fluids were prepared:

| Fluid | Weight % 1 | Weight % 2 |
|---|---|---|
| Concentrate C | 5 | 5 |
| Pentaerythritol Propylene Oxide Polymer | 0 | 1.0 |
| Thickener #4 | 2.5 | 2.5 |
| Water | 92.5 | 91.5 |

Accelerated pump tests were run on the above compositions for 17 to 21 hours with the following results.

| | 1 | 2 |
|---|---|---|
| Viscosity Loss in Pump Test S.U.S. | 108.2 | 56.6 |

This demonstrates that a pentaerythritol propylene oxide copolymer present in a moderate concentration substantially reduces viscosity loss in the pump test.

EXAMPLE 6

The compositions of Table IV below were prepared and divided into two parts. One part was put in an oven at 140° F. for 12 days to degrade the thickening agent. The other part was placed in a freezer for 12 days. From these compositions hydraulic fluid formulations consisting of 3 percent of the composition of Table IV, 5 percent of a hydraulic fluid concentrate, indicated herein as concentrate D, and 92 percent water were prepared.

Concentrate D was prepared by blending 77.45 parts by weight of water, 2 parts by weight of ethoxylated phosphate ester, 3 parts by weight of a $C_{21}$ diethoxylated diacid mixed with a $C_{21}$ diethanol diamide. 5 parts by weight of 2-amino-2-methyl-1-propanol (95 percent aqueous solution), 4.5 parts by weight of a 50 percent by weight aqueous solution of tolyltriazole, 4 parts by weight of a 95 percent solution of 2-heptyl-1-(ethoxy-propionic acid) imidazoline, sodium salt in 5 percent ethanol, 2 parts by weight of benzoic acid and 2 parts by weight polyoxyalkylene copolymer #1.

The viscosities (S.U.S.) of the hydraulic fluid formulations were then determined on all samples and the difference in viscosity for each fluid incorporating the heated part and the corresponding fluid incorporating the frozen part of each thickener determined and set forth in Table IV below. The propylene oxide polymer contains small amounts of a hindered phenol stabilizer.

TABLE IV

| Fluid | Thickener #1 | Neodecanoic Acid | Antioxidant #2 | Propylene Oxide Polymer | Propylene Glycol | Ethylene Glycol | Viscosity Loss in Sample % |
|---|---|---|---|---|---|---|---|
| 1 | 50 g | 0.1 g | 0 g | 0 g | 0 g | 0 g | none |
| 2 | 50 g | 0.2 | 0 | 0 | 0 | 0 | none |
| 3 | 50 | 0 | 0.05 | 0 | 0 | 0 | 3 |
| 4 | 50 | 0 | 0.1 | 0 | 0 | 0 | 1 |
| 5 | 50 | 0 | 0 | 15 | 0 | 0 | none |
| 6 | 50 | 0 | 0 | 0 | 15 | 0 | none |
| 7 | 50 | 0 | 0 | 0 | 0 | 15 | none |
| 8 | 50 | 0.1 | 0.1 | 0 | 0 | 0 | 1 |
| 9 | 50 | 0.1 | 0 | 15 | 0 | 0 | none |
| 10 | 50 | 0.1 | 0 | 0 | 15 | 0 | none |
| 11 | 50 | 0 | 0.1 | 15 | 0 | 0 | none |
| 12 | 50 | 0.1 | 0.1 | 15 | 0 | 0 | none |
| 13 | 50 | 0 | 0 | 0 | 0 | 0 | 6 |

What is claimed is:

1. A hydraulic fluid composition comprising water; an organic thickener which is a polyether polyol having a molecular weight of about 100 to about 40,000 prepared by reacting ethylene oxide or ethylene oxide and at least one lower alkylene oxide having 3 to 4 carbon atoms with at least one active hydrogen-containing compound and at least one alpha-olefin oxide or glycidyl ether having a carbon chain of about 10 to about 22 aliphatic carbon atoms wherein said alpha-olefin oxide or glycidyl ether is present in the amount of 1 to about 20 percent by weight based upon the total weight of said thickener; and a polyoxyalkylene polymer or copolymer having at least 50 percent by weight oxypropylene groups and an average molecular weight of about 75 to about 5000.

2. The hydraulic fluid composition of claim 1 wherein the total amount of propylene glycol polymer and copolymer is about 0.1 to 50 percent and said thickener is about 1 to 10 percent by weight of said hydraulic fluid.

3. The hydraulic fluid composition of claim 2 wherein optional additives are used selected from the group consisting of (a) phosphate esters of salts thereof selected from the group consisting of:

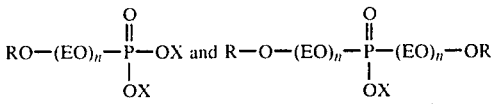

and mixtures thereof wherein ethylene oxide groups are represented by EO; R is selected from the group consisting of linear or branched chain alkyl groups wherein said alkyl groups have about 6 to 30 carbon atoms, preferably about 8 to 20 carbon atoms, or alkylaryl groups wherein the alkyl groups have about 6 to 30 carbon atoms, preferably about 8 to 18 carbon atoms, and X is selected from the group consisting of hydrogen, alkali or alkaline earth metal, the residue of ammonia or an amine and mixtures thereof, and n is a number from 1 to 50;

(b) an alkyldialkanolamide of the formula:

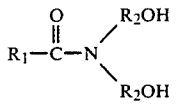

wherein $R_1$ is alkyl of about 4 to about 54 carbon atoms and $R_2$ is alkyl of about 2 to about 6 carbon atoms;

(c) a metal deactivator;

(d) a corrosion inhibitor;

(e) a defoamer;

(f) water-soluble ethers or esters of ethoxylated $C_8$–$C_{36}$ aliphatic monohydric or polyhydric alcohols; or acids and (g) sulfur compound additives selected from the group consisting of the ammonia, amine or metal salts of 2-mercaptobenzothiazole or 5-, 6- and 7-substituted 2-mercaptobenzothiazole, and sulfurized molybdenum and antimony compounds represented by the formula:

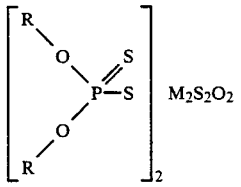

wherein M is molybdenum or antimony and R is organic and is selected from the group consisting of $C_3$–$C_{20}$ alkyl, aryl, alkylaryl radicals and mixtures thereof.

4. The composition of claim 3 wherein the amounts by weight of said additives are about 0.01 to 3.0 percent of said phosphate ester, about 0.01 to 3.0 percent alkyl dialkanolamide, about 0.02 to 5.0 percent metal deactivator, about 0.02 to 2.0 percent of said defoamer, about 0.05 to 10 percent of said corrosion inhibitors, about 0.01 to 3.0 percent of water-soluble ether or ester and about 0.01 to 2.0 percent of said sulfur compound.

5. The composition of claim 4 wherein said corrosion inhibitors include nitrates; nitrites; benzoates, amines, and imidazolines having the formula:

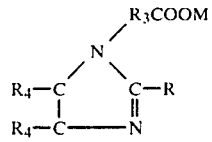

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal, and the amount by weight of said imidazolines is about 0.02 to 2.0 percent, said benzoates is about 0.01 to 2.0 percent and said amines is about 0.02 to 2.0 percent.

6. A process for preparing a hydraulic fluid comprising blending water; an organic thickener which is a polyether polyol having a molecular weight of about 100 to about 40,000 prepared by reacting ethylene oxide or ethylene oxide and at least one lower alkylene oxide having 3 to 4 carbon atoms with at least one active hydrogen-containing compound and at least one alpha-olefin oxide or glycidyl ether having a carbon chain length of about 10 to about 22 aliphatic carbon atoms wherein said alpha-olefin oxide or glycidyl ether is present in the amount of 1 to about 20 percent by weight based upon the total weight of said thickener; and a polyoxyalkylene polymer or copolymer containing at least 50 percent by weight of oxypropylene groups and an average molecular weight of about 75 to about 5000.

7. The process of claim 6 wherein the total amount of propylene glycol polymer and copolymer is about 0.1 to 50 percent and said thickener is about 1 to 10 percent by weight of said hydraulic fluid.

8. The process of claim 7 wherein optional additives are used selected from the group consisting of (a) phosphate esters of salts thereof selected from the group consisting of:

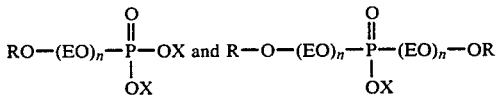

and mixtures thereof wherein ethylene oxide groups are represented by EO; R is selected from the group consisting of linear or branched chain alkyl groups wherein said alkyl groups have about 6 to 30 carbon atoms, preferably about 8 to 20 carbon atoms, or alkylaryl groups wherein the alkyl groups have about 6 to 30 carbon atoms, preferably about 8 to 18 carbon atoms, and X is selected from the group consisting of hydrogen, alkali or alkaline earth metal, the residue of ammonia or an amine and mixtures thereof, and n is a number from 1 to 50;

(b) an alkyldialkanolamide of the formula:

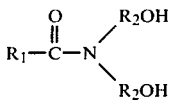

wherein $R_1$ is alkyl of about 4 to about 54 carbon atoms and $R_2$ is alkyl of about 2 to about 6 carbon atoms;

(c) a metal deactivator;

(d) a corrosion inhibitor;

(e) a defoamer;

(f) water-soluble ethers or esters of ethoxylated $C_8$–$C_{36}$ aliphatic monohydric or polyhydric alcohols; or acids and (g) sulfur compound additives selected from the group consisting of the ammonia, amine or metal salts of 2-mercaptobenzothiazole or 5-, 6- and 7-substituted 2-mercaptobenzothiazole, and sulfurized molybdenum and antimony compounds represented by the formula:

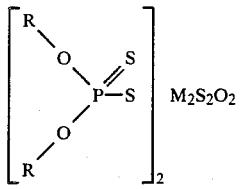

wherein M is molybdenum or animony and R is organic and is selected from the group consisting of $C_3$–$C_{20}$ alkyl, aryl, alkylaryl radicals and mixtures thereof.

9. The process of claim 8 wherein the amounts by weight of said additives are about 0.01 to 3.0 percent of said phosphate ester, about 0.01 to 3.0 percent alkyl dialkanolamide, about 0.02 to 5.0 percent metal deactivator, about 0.02 to 2.0 percent of said defoamer, about 0.05 to 10 percent of said corrosion inhibitors, about 0.01 to 3.0 percent of water-soluble ether or ester and about 0.01 to 2.0 percent of said sulfur compound.

10. The process of claim 9 wherein said corrosion inhibitors include nitrates; nitrites; benzoates, amines, and imidazolines having the formula:

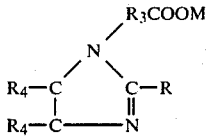

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal, and the amount by weight of said imidazolines is about 0.02 to 2.0 percent, said benzoates is about 0.01 to 2.0 percent and said amines is about 0.02 to 2.0 percent.

* * * * *